US012540629B2

(12) United States Patent
Lin et al.

(10) Patent No.: US 12,540,629 B2
(45) Date of Patent: Feb. 3, 2026

(54) FAN WHEEL HEAT DISSIPATION STRUCTURE

(71) Applicant: Global WIN Technology Co., Ltd., Taipei (TW)

(72) Inventors: Shih-Jen Lin, Taipei (TW); Ching-Yao Chen, Taipei (TW)

(73) Assignee: GLOBAL WIN TECHNOLOGY CO., LTD., Taipei (TW)

( * ) Notice: Subject to any disclaimer, the term of this patent is extended or adjusted under 35 U.S.C. 154(b) by 0 days.

(21) Appl. No.: 18/882,992

(22) Filed: Sep. 12, 2024

(65) Prior Publication Data

US 2025/0215896 A1 Jul. 3, 2025

(30) Foreign Application Priority Data

Jan. 2, 2024 (TW) ..... 113100123

(51) Int. Cl.
*F04D 29/32* (2006.01)
*F04D 25/08* (2006.01)
*F04D 29/58* (2006.01)

(52) U.S. Cl.
CPC ..... *F04D 29/329* (2013.01); *F04D 25/082* (2013.01); *F04D 29/5806* (2013.01); *F04D 29/584* (2013.01)

(58) Field of Classification Search
None
See application file for complete search history.

(56) References Cited

U.S. PATENT DOCUMENTS 5,997,265 A * 12/1999 Chung ..... F04D 29/063 417/423.7
8,899,930 B2 * 12/2014 Innocenti ..... F04D 29/5806 416/169 A
9,512,726 B2 * 12/2016 Ren ..... F04D 29/666
2012/0189451 A1 * 7/2012 Innocenti ..... F04D 29/5806 416/189
2014/0064973 A1 * 3/2014 Ren ..... F04D 29/388 29/889.6

OTHER PUBLICATIONS

De Filippis et al (WO 200613134 A1) + machine translation (Year: 2006).*
Yan et al (TW 200910064 A) + machine translation (Year: 2009).*

* cited by examiner

*Primary Examiner* — Juan G Flores
(74) *Attorney, Agent, or Firm* — MUNCY, GEISSLER, OLDS & LOWE, P.C.

(57) ABSTRACT

A fan wheel heat dissipation structure includes a fan wheel and an air diversion radiator plate having an airflow guide ring surrounding a rotating shaft and airflow guide ribs with an air duct formed between each two adjacent airflow guide ribs, each air duct having an air inlet slot on one side to guide in external airflow and an airflow turning curved surface on an opposite side to guide intake airflow to be extruded outward, and a fan frame including an accommodation space for mounting the fan wheel and a shaft seat, a shaft seat disc mounted in the shaft seat, a shaft seat bracket, a fan air outlet, a shaft sleeve protruding from shaft seat disc for assembly of the rotating shaft, and through holes located outside the shaft seat and aligned with the internal space of the fan hub.

5 Claims, 14 Drawing Sheets

FAN WHEEL HEAT DISSIPATION STRUCTURE

This application claims the priority benefit of Taiwan patent application number 113100123, filed on Jan. 2, 2024.

BACKGROUND OF THE INVENTION

1. Field of the Invention

The present invention provides a fan wheel heat dissipation structure, especially a fan structure that can dissipate heat from the internal space of the fan wheel by providing an air diversion radiator plate on the top of the inner space of the fan hub, which can guide the external airflow to circulate and be discharged in the inner space to achieve the purpose of dissipating heat in the inner space.

2. Description of the Related Art

Today's computers have powerful computing capabilities and their speeds are rapidly increasing to enhance the execution performance of computers. Since various electronic components such as the central processing unit (CPU), image processor, power supply or various interface cards inside the computer host have ultra-high-speed computing functions, various electronic components will generate relatively large amounts of high temperature heat energy when processing computing instructions. The high temperature heat energy also causes the temperature inside the computer host to rise. Due to poor heat dissipation performance, the heat dissipation devices, fans, etc. used to assist various electronic components in dissipating heat will cause unsatisfactory air convection inside the computer host, which will cause the computer host to overheat and cause crashes or forced shutdowns, and may even cause malfunction or damage to various electronic components inside the computer host. Therefore, how to use a good heat dissipation system to effectively dissipate heat for various electronic components and operate normally at their allowed temperatures has become an important issue that the industry pays attention to.

However, the functions currently used in servers require the storage, transmission and calculation of increasingly larger amounts of data. Therefore, the central processing unit (CPU) used in servers also generates more heat due to its improved computing capabilities. Temperature difference, thermal conductivity and wattage also increase at the same time. The fan used to dissipate heat for the central processing unit (CPU) of the server must dissipate the increased wattage of the server through the fan. Because under the existing fan height size (1 U or 2 U) specification, the heat dissipation performance of the fan can only be increased by increasing the fan speed, and the wattage of the fan motor needs to be increased to cope with the increase in fan speed. However, when the wattage of the motor is increased, the silicon steel sheets and enameled wire winding sets of the motor will be easily burned out due to high temperature, which poses a high risk and must be improved.

Therefore, how to solve the problems and troubles of the current heat dissipation device fans in assisting various electronic components in dissipating heat that the fan speed must be increased, which may easily cause the fan motor to burn out easily due to the increase in server wattage, and the fan has troubles and shortcomings such as difficulty in improving heat dissipation performance due to existing height restrictions, which is the direction for improvement that relevant manufacturers in this industry urgently want to study.

SUMMARY OF THE INVENTION

Therefore, in view of the above problems and deficiencies, the inventor collected relevant information, evaluated and considered many aspects, and used his many years of experience in this industry to design such a fan wheel heat dissipation structure through continuous creation and modification.

The main object of the present invention is to provide a fan wheel heat dissipation structure comprising a fan wheel and a fan frame. The fan wheel comprises a fan hub provided with an internal space, a plurality of fan blades surrounding an outer surface of the fan hub, a rotating shaft inserted through the internal space, and an air diversion radiator plate surrounding the rotating shaft located on the top surface of the internal space. The air diversion radiator plate comprises at least one airflow guide rib and an airflow guide ring. The airflow guide rib extends from the outside of the rotating shaft pivot seat in a parabolic path to the inner peripheral surface of the airflow guide ring and is connected at an approximate tangent to form at least one air duct. The wide space on one side of the air duct forms an air inlet slot that guides external airflow in, and the narrow space on the other side of the air duct forms an airflow turning curved surface that guides the airflow to be squeezed downward and outward. The inner peripheral surface of the airflow guide ring is connected to the inner peripheral surface of the rotor magnet to facilitate the smooth airflow. An escape space is formed between the inner peripheral surface of the rotor magnet and the outer silicon steel sheets for the extruded hot air to be discharged outward. The fan frame comprises an accommodation space for assembling the fan wheel, a shaft seat mounted in the accommodation space, a shaft seat disc mounted in the shaft seat, a shaft seat bracket, a fan air outlet, and a shaft sleeve protruding from shaft seat disc for assembly of the rotating shaft. A plurality of through holes are provided at the bottom of the accommodation space outside the shaft seat to align with the internal space of the fan hub, so as to guide the external low-temperature airflow to circulate between the circulation space between the stator silicon steel sheets of the motor and the internal space of the fan hub of the fan wheel to achieve the purpose of heat dissipation and extending the service life of the fan. The airflow generated by the rotation of the fan motor in the air duct in the fan blade of the fan hub forms a forced convection, which takes away the high-temperature heat energy generated by the high-speed rotation of the stator silicon steel sheet sets in conjunction with the rotor magnet. This can significantly reduce the raised temperature of the motor due to high-speed rotation, ensuring that the fan motor is not easily burned out and can operate normally, and the service life of the fan can be extended.

Another object of the present invention is to provide a fan wheel heat dissipation structure comprising a fan wheel and a fan frame. An air diversion radiator plate is set on the top surface of the internal space of the fan hub of the fan wheel. The air diversion radiator plate comprises a plurality of airflow guide ribs surrounding the exterior of the rotating shaft of the fan. An air duct is formed between the outer peripheral surface of each airflow guide rib and the inner peripheral surface of the airflow guide ring for guiding in airflow. The wide space on one side of the air duct forms an air inlet slot, which guides the external low-temperature airflow into a circulation space between each stator silicon steel sheet set (including the plurality of inner silicon steel sheets, the plurality of outer silicon steel sheets and enameled wire winding set) of the motor through the air flow duct between the bottom of fan frame and the circuit board and between the circuit board and silicon steel sheet sets, and then into the air inlet slot and so that the entered airflow is squeezed to flow toward the airflow turning curved surface of the narrow space on the other side of the air duct. After the airflow is squeezed, the high temperature generated by each stator silicon steel sheet set cooperating with the high-wattage rotation of the rotor magnet can be discharged outward and cooled down through the escape space between the rotor magnet and the outer silicon steel sheet through the airflow turning curved surface. This has the advantage of reducing the temperature that increases when the motor operates at high speed.

Still another object of the present invention is to provide a fan wheel heat dissipation structure comprising a fan wheel and a fan frame. An air diversion radiator plate is set on the top surface of the internal space of the fan hub of the fan wheel. The air diversion radiator plate comprises a plurality of airflow guide ribs surrounding the exterior of the rotating shaft. The space between each airflow guide rib outer peripheral surface and the airflow guide ring inner peripheral surface forms at least one air duct that guides airflow to enter. The space of the air duct extends from wide to narrow to another adjacent air duct. An air inlet slot is formed in the wide space on one side of either air duct, and the external low-temperature airflow is guided to enter through the through holes at the bottom of the fan frame, and then passes through the air flow duct between the shaft seat and the circuit board into the circulation space between each stator silicon steel sheet (including the plurality of inner silicon steel sheets, the plurality of outer silicon steel sheets and enameled wire winding set.) of the motor, and then enter the air inlet slot, and then airflow is squeezed toward the airflow turning curved surface in the narrow space on the other side of the air duct. After the airflow is squeezed, the high temperature generated by each stator silicon steel sheet set cooperating with the high-speed rotation of the rotor magnet can be discharged outward and cooled down through the escape space between the rotor magnet and the outer silicon steel sheets through the airflow turning curved surface, thereby reducing the temperature that increases when the motor is running at high speed.

DETAILED DESCRIPTION OF THE PREFERRED EMBODIMENT

Figure 1:
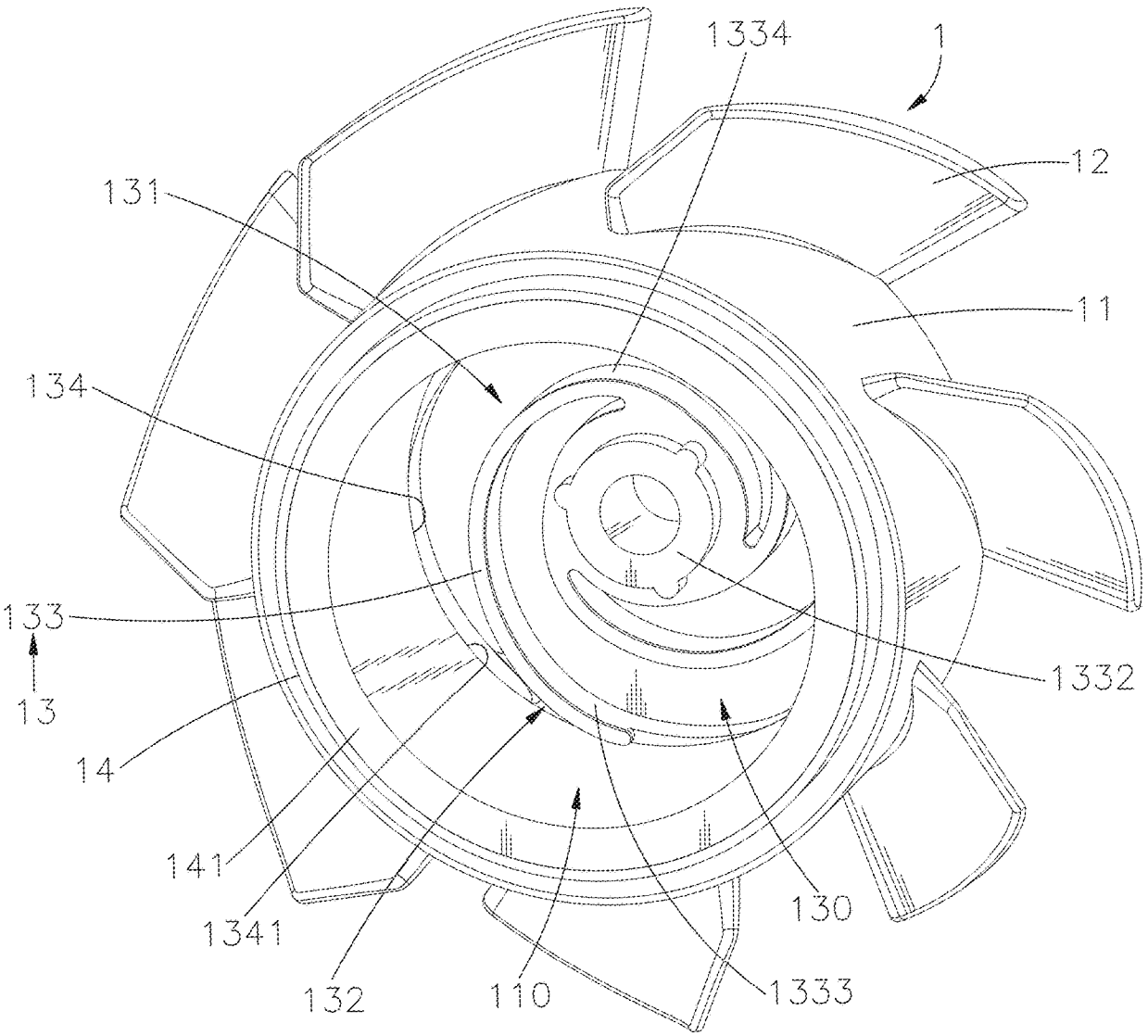
FIG. 1 is a three-dimensional appearance view of the first embodiment of the fan wheel of the present invention.
Figure 2:
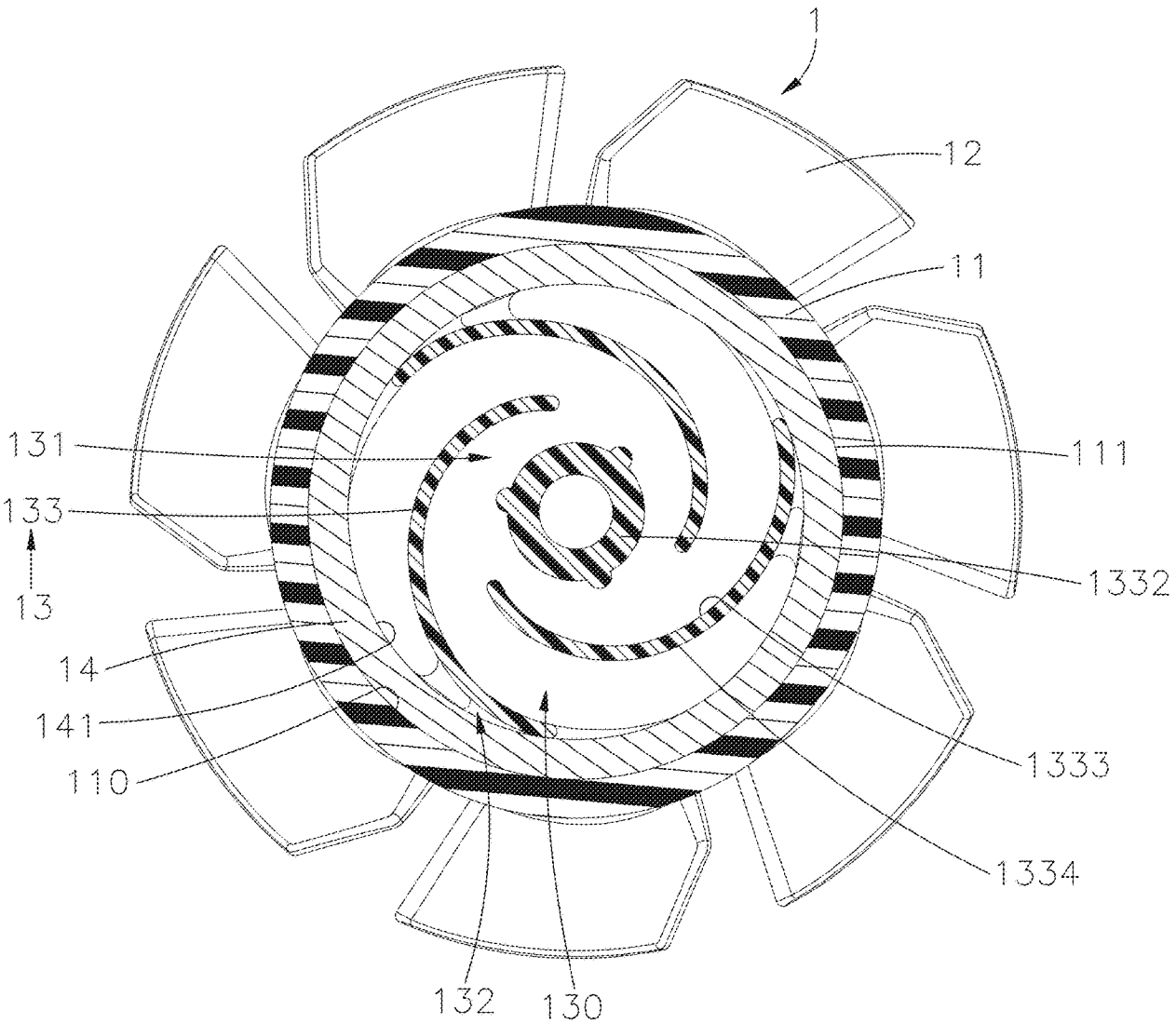
FIG. 2 is a schematic plan view of the first embodiment of the fan wheel of the present invention.
Figure 3:
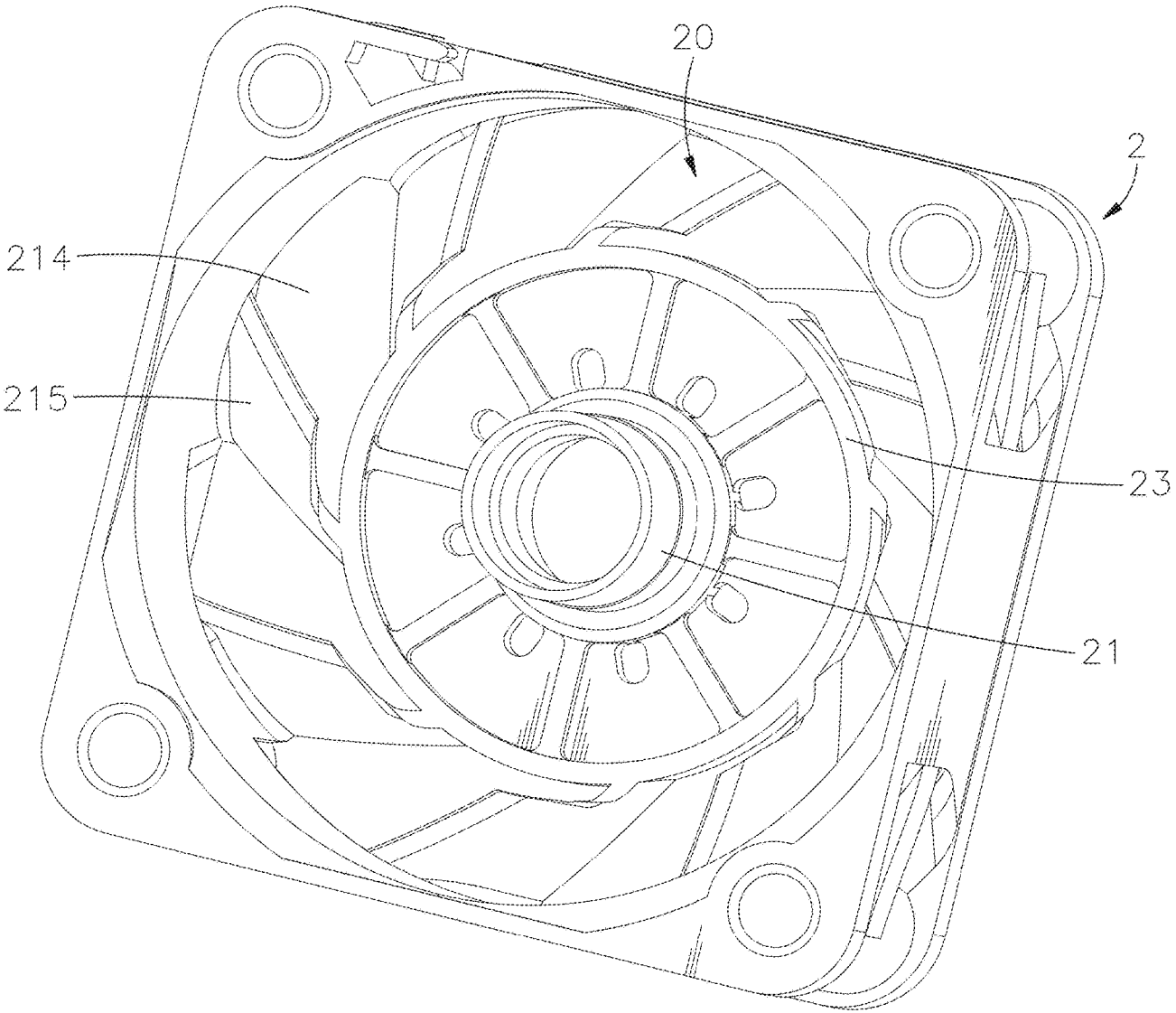
FIG. 3 is a three-dimensional appearance view of the fan frame of the present invention.
Figure 4:
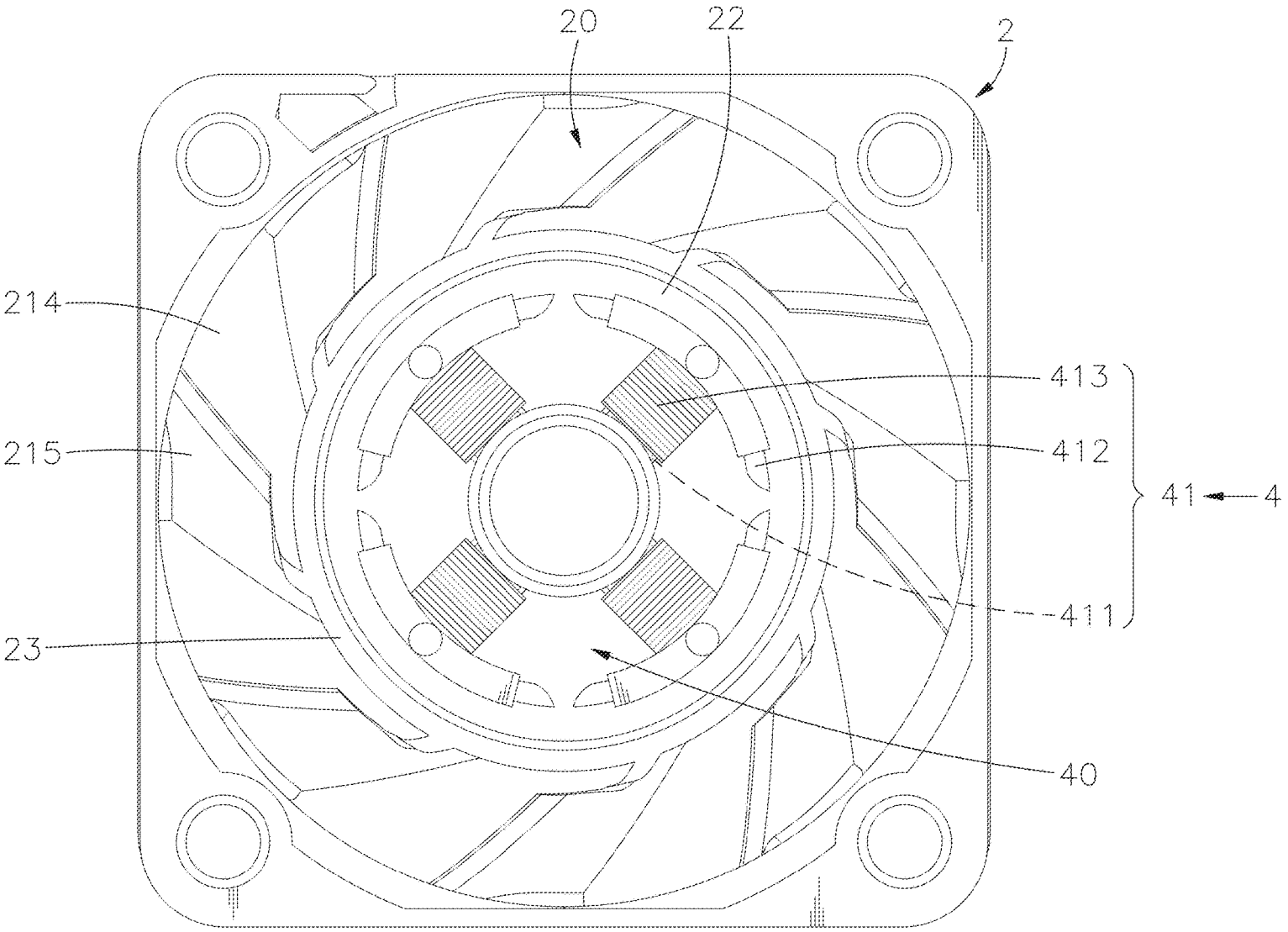
FIG. 4 is a top view of the fan frame and stator silicon steel sheet set of the present invention.

In order to achieve the above-mentioned objects and effects, the technical means adopted in the present invention, its structure and the method of implementation, etc., are hereby drawn in detail to illustrate the features and functions of the preferred embodiments of the present invention as follows, so as to facilitate a complete understanding.

Please refer to FIGS. 1 to 14. It can be clearly seen from the figures that the fan wheel heat dissipation structure of the present invention comprises a fan wheel 1 and a fan frame 2 (please also refer to FIG. 5, there is no air flow channels 220 and through holes 201, only the air flow duct 410).

The fan wheel 1 comprises a fan hub 11 and a plurality of fan blades 12 surrounding its outer surface. The fan hub 11 is provided with an internal space 110, and a rotor magnet 14 is provided on the wall surface 111 of the internal space 110, and a preset rotating shaft 3 can be inserted there through. The top surface of the internal space 110 is provided with an air diversion radiator plate 13 surrounding the exterior of the preset rotating shaft 3. The air diversion radiator plate 13 is composed of at least one airflow guide rib 133 and an airflow guide ring 134. The rotor magnet 14 is provided on the wall surface 111 of the internal space 110 of the fan hub 11 below the airflow guide ring 134. The airflow guide ring inner peripheral surface 1341 is connected to the rotor magnet inner peripheral surface 141 to facilitate the smooth flow of air through the escape space 140. At least one space from wide to narrow is formed between each airflow guide rib 133 of the air diversion radiator plate 13 and the airflow guide ring 134 of the air diversion radiator plate 13 to form an air duct 130, that is, the airflow guide rib 133 extends from the outside of the rotating shaft pivot seat 1332 in a parabolic path to the airflow guide ring inner peripheral surface 1341 and is connected at an approximate tangent to form at least one air duct 130. An air inlet slot 131 is formed in the wide space on one side of the air duct 130 to guide in external airflow, and the narrow space on the other side of the air duct 130 forms an airflow turning curved surface 132 that guides the airflow to be squeezed downward and discharged outward. An escape space 140 is formed between the rotor magnet inner peripheral surface 141 and the outer silicon steel sheets 412 for the extruded hot air to be discharged outward.

The fan frame 2 comprises an accommodation space 20 for assembling the fan wheel 1, a shaft seat 21, a shaft seat disc 23, a shaft seat bracket 213 and a fan air outlet 214. A shaft sleeve 211 is protruding from the shaft seat disc 23 in the shaft seat 21 inside the accommodation space 20 for assembling the preset rotating shaft 3. A plurality of through holes 201 are provided at the bottom of the accommodation space 20 outside the shaft seat 21 to align with the internal space 110 of the fan hub 11. A circuit board 22 is provided on the shaft seat 21 in the accommodation space 20, and a plurality of stator silicon steel sheet sets 41 (each including a plurality of inner silicon steel sheets 411 and a plurality of outer silicon steel sheets 412 and an enameled wire winding set 413) of the preset motor 4 are provided on the circuit board 22. The stator silicon steel sheet sets 41 are in an I-shaped and arranged around the outside of the shaft sleeve 211 of the shaft seat 21. A circulation space 40 is formed between the plurality of inner silicon steel sheets 411, the plurality of outer silicon steel sheets 412 and an enameled wire winding set 413 of each I-shaped stator silicon steel sheet set 41 and the shaft seat 21. There is an air flow duct 410 between the bottom surface of the stator silicon steel sheet set 41 and the circuit board 22. An escape space 140 is formed between each stator silicon steel sheet set 41 of the preset motor 4 and the rotor magnet 14. The above-mentioned fan wheel 1 of the present invention forms at least one air duct 130 between each airflow guide rib outer peripheral surface 1334 in the internal space 110 of the fan hub 11 and the airflow guide ring inner peripheral surface 1341 for guiding in airflow. The wide space on one side of the air duct 130 forms an air inlet slot 131, which guides the external low-temperature air flow through the air flow duct 410 between the bottom surface of the stator silicon steel sheet sets 41 and the circuit board 22 into the circulation space 40 between each stator silicon steel sheet set 41 (including the plurality of inner silicon steel sheets 411, the plurality of outer silicon steel sheets 412 and the enameled wire winding set 413) of the preset motor 4, and then into the air inlet slot 131 and so that the entered airflow is squeezed to flow toward the airflow turning curved surface 132 of the narrow space on the other side of the air duct 130. After the guide airflow is squeezed, through the airflow turning curved surface 132, the high temperature generated by each stator silicon steel sheet set 41 the high-speed rotation of the rotor magnet 14 can be discharged to the outside and cooled down the air through the escape space 140 between the rotor magnet 14 and the outer silicon steel sheets 412, thereby reducing the temperature raised when the preset motor 4 operates at high speed.

Figure 5:
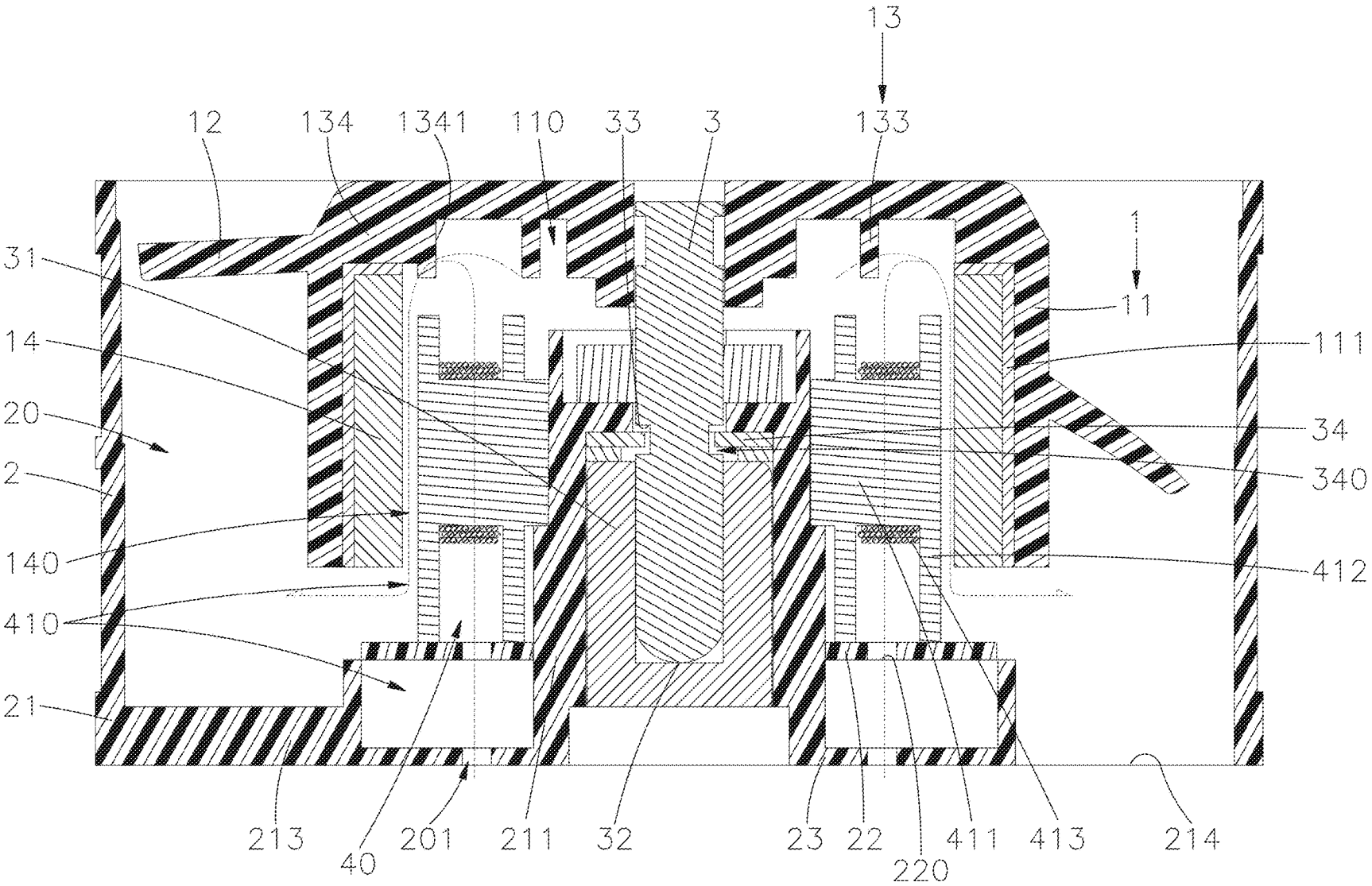
FIG. 5 is a side cross-sectional view of the first embodiment of the present invention.
Figure 6:
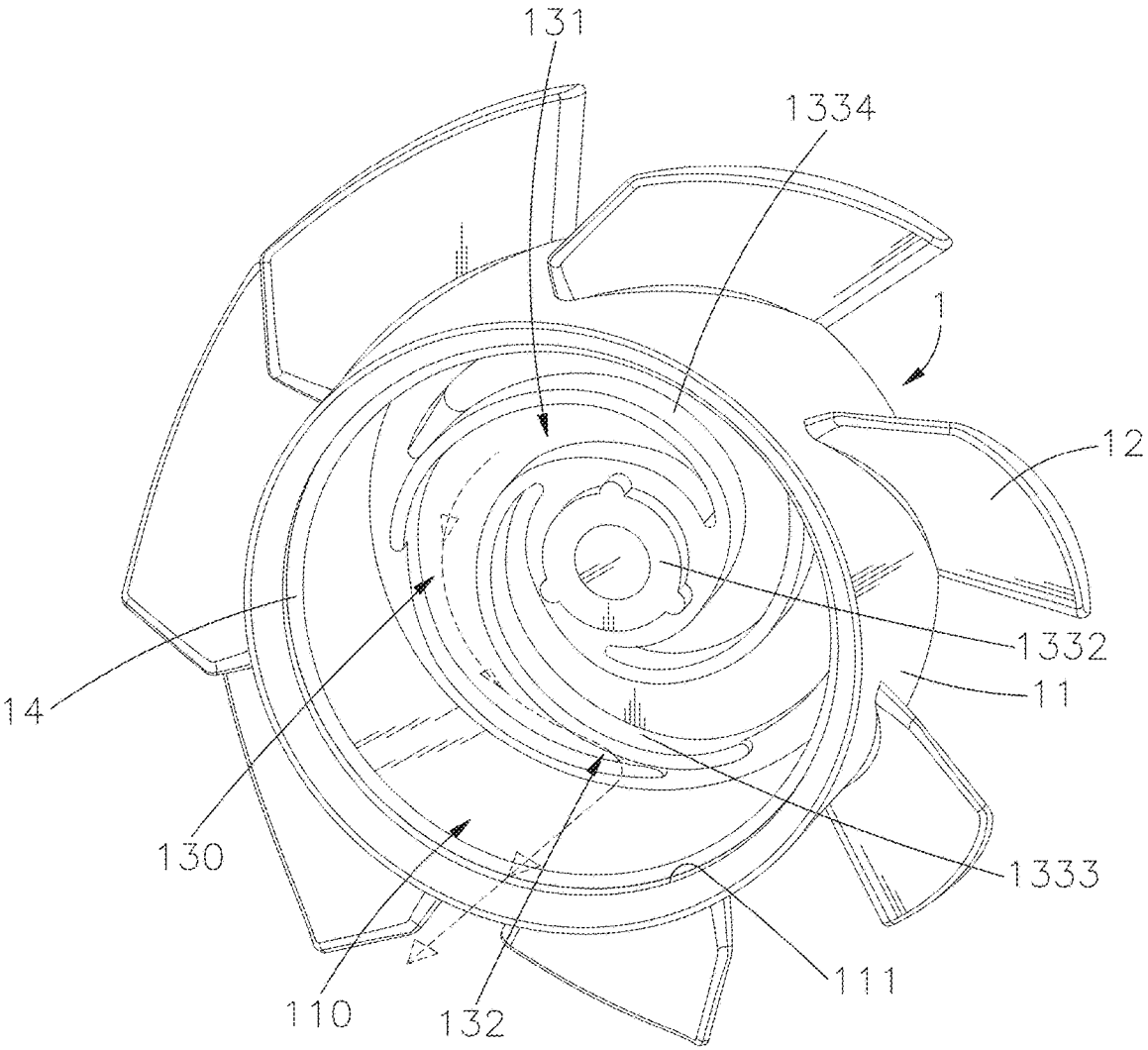
FIG. 6 is a three-dimensional appearance view of the fan wheel according to the second embodiment of the present invention.
Figure 7:
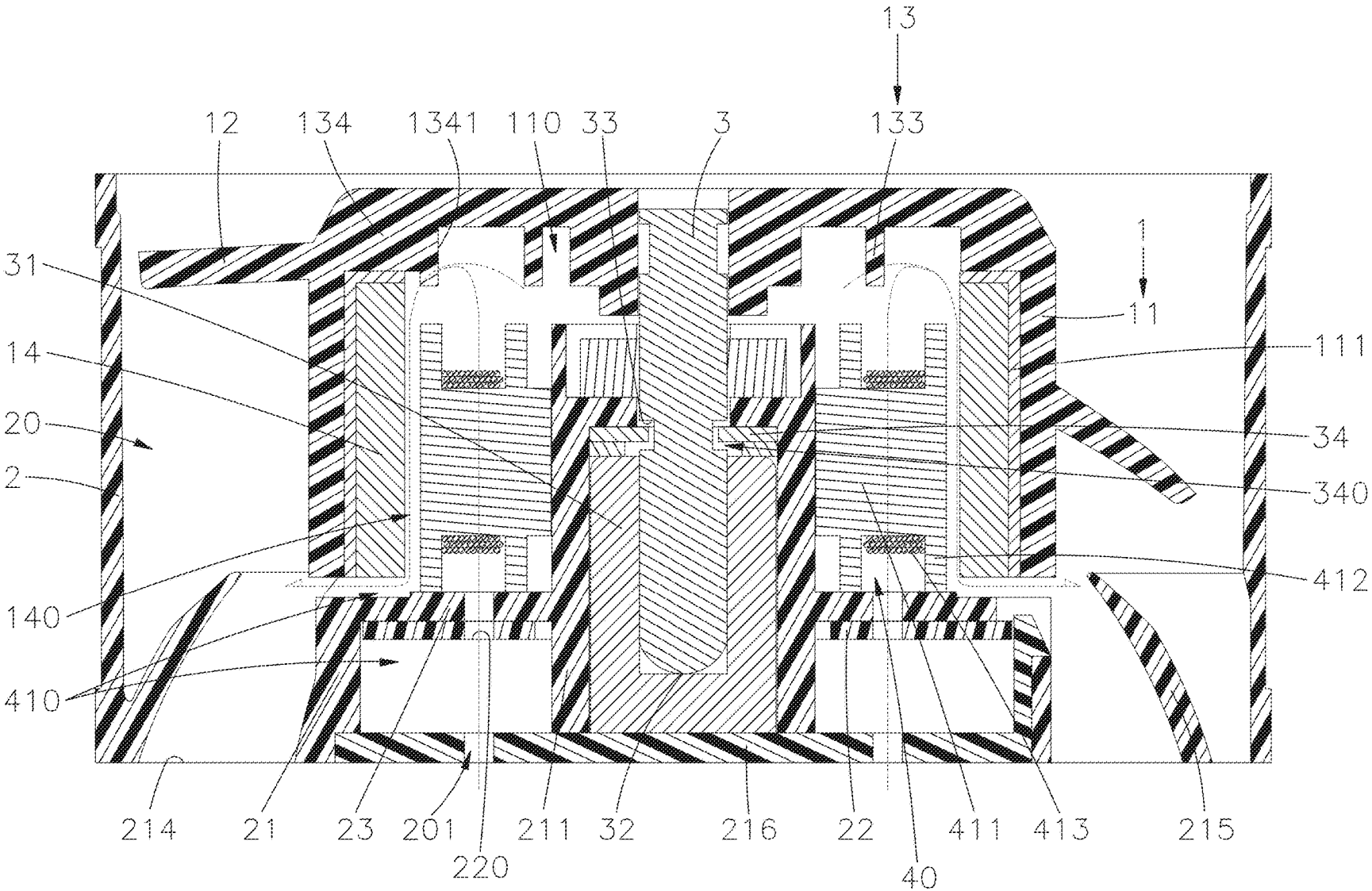
FIG. 7 is a side cross-sectional view of the second embodiment of the present invention.

Please also refer to FIG. 5, and assume that there is an air flow channel 220 in the middle of the circuit board 22 or between the circuit board 22 and the shaft seat 21. At this time, there are no through holes 201, only the air flow channel 220 and the air flow duct 410. There is an accommodation space 20 inside the fan frame 2 for assembling the fan wheel 1. There is a shaft sleeve 211 protruding from the shaft seat 21 inside the accommodation space 20, and the shaft sleeve 211 can be used for the assembly of the preset rotating shaft 3. A circuit board 22 is provided on the shaft seat 21 in the accommodation space 20, and the circuit board 22 is provided with a plurality of stator silicon steel sheet sets 41 of the preset motor 4 (including a plurality of inner silicon steel sheets 411 and a plurality of outer silicon steel sheets 412 and an enameled wire winding sets 413). The stator silicon steel sheet sets 41 are in an I-shaped and arranged around the outside of the shaft sleeve 211 of the shaft seat 21. A circulation space 40 is formed between the plurality of inner silicon steel sheets 411, the plurality of outer silicon steel sheets 412 and the enameled wire winding set 413 of each I-shaped stator silicon steel sheet set 41 and the shaft seat 21. An air flow channel 220 is formed in the middle of the circuit board 22 or between the circuit board 22 and the shaft seat 21, and an escape space 140 is formed between each stator silicon steel sheet set 41 of the preset motor 4 and the rotor magnet 14. The above-mentioned fan wheel 1 of the present invention forms at least one air duct 130 between each airflow guide rib outer peripheral surface 1334 in the internal space 110 of the fan hub 11 and the airflow guide ring inner peripheral surface 1341 for guiding in airflow. The wide space on one side of the air duct 130 forms an air inlet slot 131, which guides the external low-temperature air flow from the air flow duct 410 below the circuit board 22 through the air flow channel 220 between the shaft seat 21 and the circuit board 22 to enter into the circulation space 40 between each stator silicon steel sheet set 41 (including the plurality of inner silicon steel sheets 411, the plurality of outer silicon steel sheets 412 and the enameled wire winding set 413) of the preset motor 4, and then into the air inlet slot 131 and so that the entered airflow is squeezed to the airflow turning curved surface 132 of the narrow space on the other side of the air duct 130. After the guide airflow is squeezed, through the airflow turning curved surface 132, the high temperature generated by each stator silicon steel sheet set 41 due to the high-speed rotation of the rotor magnet 14 can be discharged to the outside and cooled down the air through the escape space 140 between the rotor magnet 14 and the outer silicon steel sheets 412, thereby reducing the temperature raised when the preset motor 4 operates at high speed.

Figure 8:
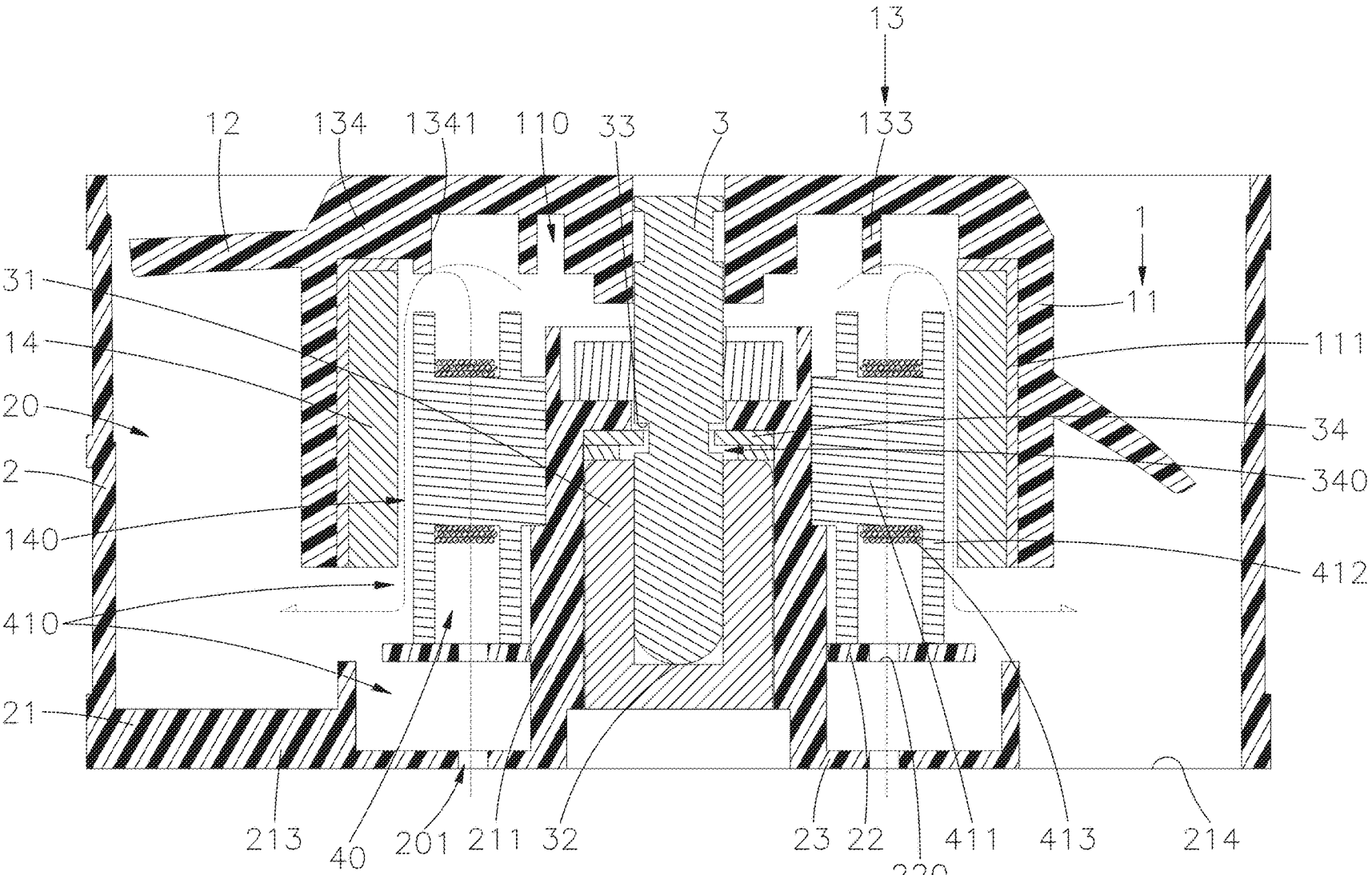
FIG. 8 is a side cross-sectional view of the third embodiment of the present invention.

Also, as shown in FIG. 8, the fan wheel 1 of the above-mentioned invention is provided with a plurality of through holes 201 at the bottom of the accommodation space 20 outside the shaft seat 21, corresponding to the internal space 110 of the fan hub 11. A circuit board 22 is provided on the shaft seat 21 in the accommodation space 20, and the circuit board 22 is provided with a plurality of stator silicon steel sheet sets 41 of the preset motor 4 (including a plurality of inner silicon steel sheets 411 and a plurality of outer silicon steel sheets 412 and enameled wire winding sets 413). The stator silicon steel sheet sets 41 are in an I-shaped and arranged around the shaft seat 21. A circulation space 40 is formed between the plurality of inner silicon steel sheets 411, the plurality of outer silicon steel sheets 412 and the enameled wire winding set 413 of each I-shaped stator silicon steel sheet set 41 and the shaft seat 21. An air flow channel 220 is formed between the circuit board 22 and the shaft seat 21. The wall surface 111 of the internal space 110 of the fan hub 11 is equipped with a rotor magnet 14. An escape space 140 is formed between the rotor magnet 14 and the plurality of outer silicon steel sheets 412 for air flow to pass through and be discharged outward, so as to reduce the temperature of the stator silicon steel sheet sets 41 of the preset motor 4 of the internal space 110 (including the plurality of inner silicon steel sheets 411, the plurality of outer silicon steel sheets 412 and the enameled wire winding set 413). The fan frame 2 is equipped with a U-shaped bearing 31 inside, and the circuit board 22 is set outside the shaft sleeve 211 of the shaft seat 21 so that the circuit board 22 can be electrically connected with each stator silicon steel sheet set 41 of the preset motor 4.

The fan wheel 1 of the present invention is provided with a plurality of fan blades 12 surrounding the fan hub 11 and its outer surface. The fan hub 11 is equipped with an internal space 110, and the wall surface 111 of the internal space 110 is equipped with a rotor magnet 14, and can be installed with a preset rotating shaft 3. The top surface of the internal space 110 is provided with an air diversion radiator plate 13 surrounding the exterior of the preset rotating shaft 3. The air diversion radiator plate 13 is composed of at least one airflow guide rib 133 and an airflow guide ring 134. The wall surface 111 below the airflow guide ring 134 in the internal space 110 of the fan hub 11 is provided with the rotor magnet 14, and the airflow guide ring inner peripheral surface 1341 is connected to the rotor magnet inner peripheral surface 141 to facilitate the smooth flow of air through the escape space 140. At least one air duct 130 is formed by forming at least one space from wide to narrow between the airflow guide rib 133 of the air diversion radiator plate 13 and the airflow guide ring 134 of the air diversion radiator plate 13, that is, the airflow guide rib 133 extends from the outside of the rotating shaft pivot seat 1332 in a parabolic path to the airflow guide ring inner peripheral surface 1341 and is connected at an approximate tangent to form the at least one air duct 130. The wide space on one side of the air duct 130 forms an air inlet slot 131 that guides external airflow to enter, and the narrow space on the other side of the air duct 130 forms the airflow turning curved surface 132 that guides the airflow to be squeezed downward and outward. An escape space 140 is formed between the rotor magnet inner peripheral surface 141 and the outer silicon steel sheets 412 for the extruded hot air to be discharged outward. That is, when the stator silicon steel sheet sets 41 of the preset motor 4 drive the rotor magnet 14 to rotate to drive the plurality of fan blades 12 of the fan hub 11 to rotate, it can also drive the air diversion radiator plate 13 to rotate and guide the external low-temperature airflow to enter through the through holes 201 on the bottom of the fan frame 2, and then to flow through the air flow channel 220 between the shaft seat 21 and the circuit board 22 into the circulation space 40 between the plurality of inner silicon steel sheets 411, the plurality of outer silicon steel sheets 412 and the enameled wire winding set 413, and then to flow through the air duct 130 formed between the airflow guide ring 134 and the airflow guide rib outer peripheral surface 1334, so as to guide external airflow into the air inlet slot 131 on one side of the air duct 130. Then the external airflow is guided from the air inlet slot 131 to the airflow turning curved surface 132 and is extruded and turned, and then the high temperature air can be discharged outward along the escape space 140 formed between the rotor magnet 14 and the stator silicon steel sheet sets 41. That is, the high temperature, hot air generated by each stator silicon steel sheet set 41 due to the high-speed rotation of the rotor magnet 14 is taken away and cooled, so that the air flow of high temperature, hot air is squeezed from the air inlet slot 131 in the wide space on one side of the air duct 130 toward the airflow turning curved surface 132 in the narrow space on the other side. Thus, the high temperature, hot air is guided along the airflow turning curved surface 132 and the escape space 140 to hit the circuit board 22, and then to turn the flowing direction at a predetermined angle of 90° (or other angles such as 30°, 45° or 60°, etc., and the best angle can be) 90°, and after turning, the high temperature, hot air is discharged outward. Therefore, high temperature, hot air will not be accumulated in the internal space 110 of the fan hub 11 or the accommodation space 20, and each stator silicon steel sheet set 41 can be effectively cooled down to reduce the impact on the normal operation of the preset motor 4 and fan wheel 1. It has the advantages of improving the heat dissipation effect of the fan and extending the service life of the fan.

In addition, in the above embodiment of the fan wheel 1 of the present invention (please also refer to FIGS. 5 to 11), the air diversion radiator plate 13 set in the internal space 110 of the fan hub 11 of the fan wheel 1 is provided with a rotating shaft pivot seat 1332 at the central position of the internal space 110, which can be used for the rotating shaft 3 to penetrate and position, and along the periphery of the rotating shaft pivot seat 1332, a plurality of airflow guide ribs 133 can be provided in a parabola shape approaching the airflow guide ring 134. And each airflow guide rib 133 of the air diversion radiator plate 13 and the adjacent airflow guide ring 134, at least one space from narrow to wide and then to narrow is formed between the adjacent airflow guide ribs 133. The airflow guide ribs 133 extend from the outside of the rotating shaft pivot seat 1332 in a parabolic path to the airflow guide ring inner peripheral surface 1341 and are connected at an approximate tangent to form more than one air duct 130. The narrow to wide space on the side of the air duct 130 close to the rotating shaft pivot seat 1332 forms an air inlet slot 131 for guiding external airflow to enter, and the narrowest space of the wide to narrow space on the other side of the air duct 130 forms the airflow turning curved surface 132 for squeezing the guided airflow downward and discharging it outward. When the preset rotating shaft 3 drives the fan wheel 1 to rotate, the external low-temperature airflow can be guided to enter along the through holes 201 at the bottom of the fan frame 2, and then to flow through the air flow channel 220 between shaft seat 21 and the circuit board 22 and the circulation space 40 between each stator silicon steel sheet set 41 and shaft seat 21 into the air inlet slot 131 of the air duct 130 between the airflow guide rib inner peripheral surface 1333 and the airflow guide rib outer peripheral surface 1334. Then, the guided external low-temperature airflow is squeezed along the airflow guide ring inner peripheral surface 1341 to the airflow turning curved surface 132. Then, the squeezed airflow guides high temperature, hot air along the airflow turning curved surface 132 to hit the circuit board 22 along the escape space 140 between the inner peripheral surface 141 of the rotor magnet 14 and the outer silicon steel sheets 412, and then to turn the flowing direction at a predetermined angle of 90° (or other angles greater than 90°, and the best angle can be) 90°, and after turning, the high temperature, hot air is discharged out of the escape space 140 between the rotor magnet 14 and the stator silicon steel sheet sets 41. Therefore, high temperature, hot air will not be accumulated in the internal space 110 of the fan hub 11 or the accommodation space 20.

Furthermore, the above-mentioned shaft seat 21 inside the fan frame 2 can be in different design patterns such as U shape or ⊓ shape. A shaft sleeve 211 is protruding inside the shaft seat 21, and the shaft sleeve 211 can be assembled with the preset rotating shaft 3. Furthermore, a plurality of through holes 201 are provided at the bottom of the accommodation space 20 outside the shaft seat 21 to correspond to the internal space 110 of the fan hub 11. The accommodation space 20 is provided with a U-shaped shaft seat 21, and the U-shaped shaft seat 21 is provided with a circuit board 22 on the shaft sleeve 211. The circuit board 22 is provided with a plurality of stator silicon steel sheet sets 41 of the preset motor 4 (including a plurality of inner silicon steel sheets 411, a plurality of outer silicon steel sheets 412 and enameled wire winding sets 413). A plurality of air flow channels 220 can be provided on the circumference of the shaft sleeve 211 near the shaft seat 21 on the circuit board 22. The plurality of air flow channels 220 can be located at any appropriate positions on the circuit board 22, especially for the circuit board 22 located below the stator silicon steel sheet sets 41 is provided with a plurality of air flow channels 220, and a plurality of air flow channels 220 can be set at any appropriate positions below the preset motor 4 on the circuit board 22. A plurality of air flow channels 220 may also be provided at any appropriate locations on the circuit board 22 where electronic components are not provided. It is not limited to the location where a plurality of air flow channels 220 set on the circuit board 22.

Figure 9:
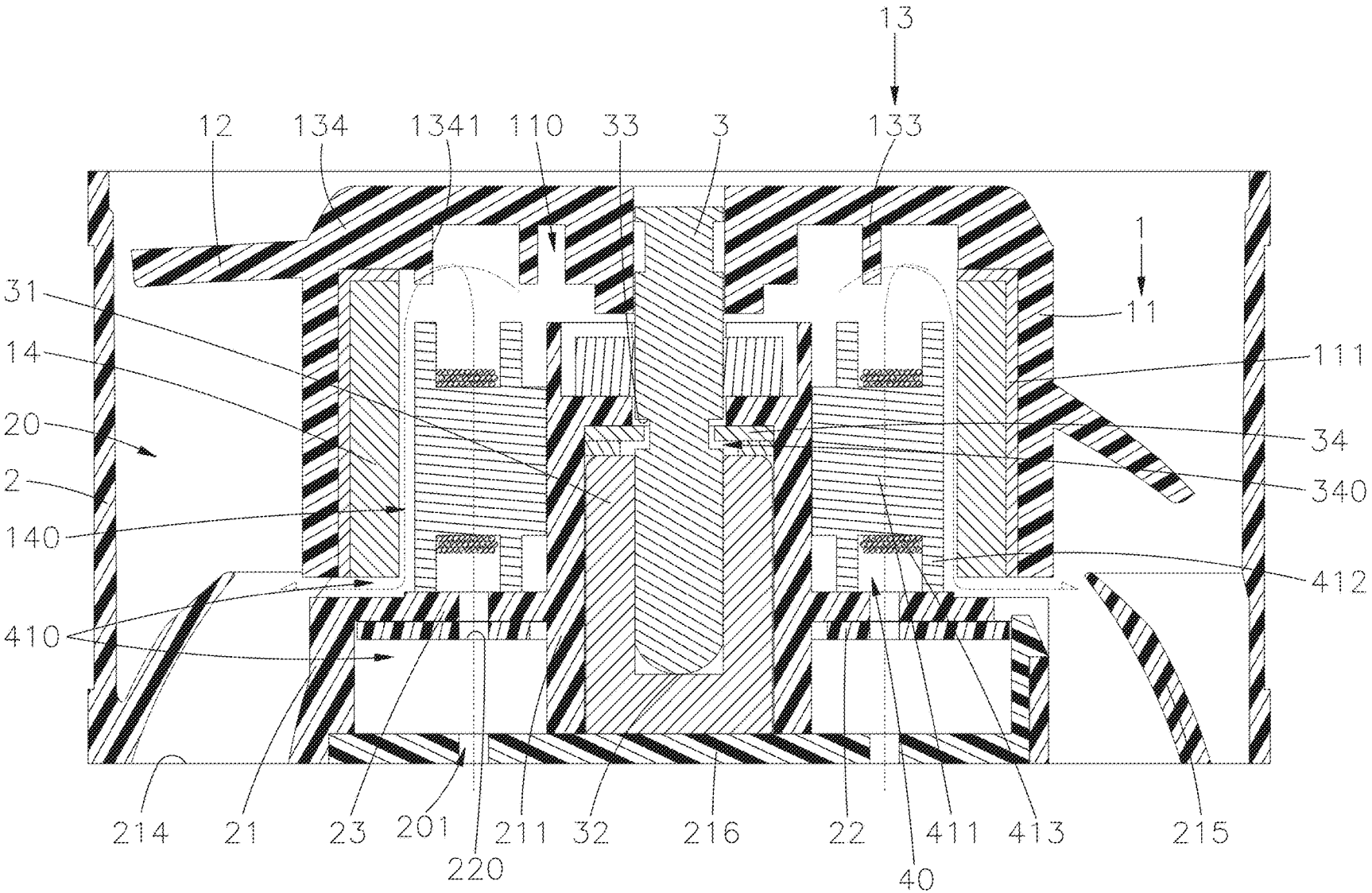
FIG. 9 is a side cross-sectional view of the fourth embodiment of the present invention.
Figure 10:
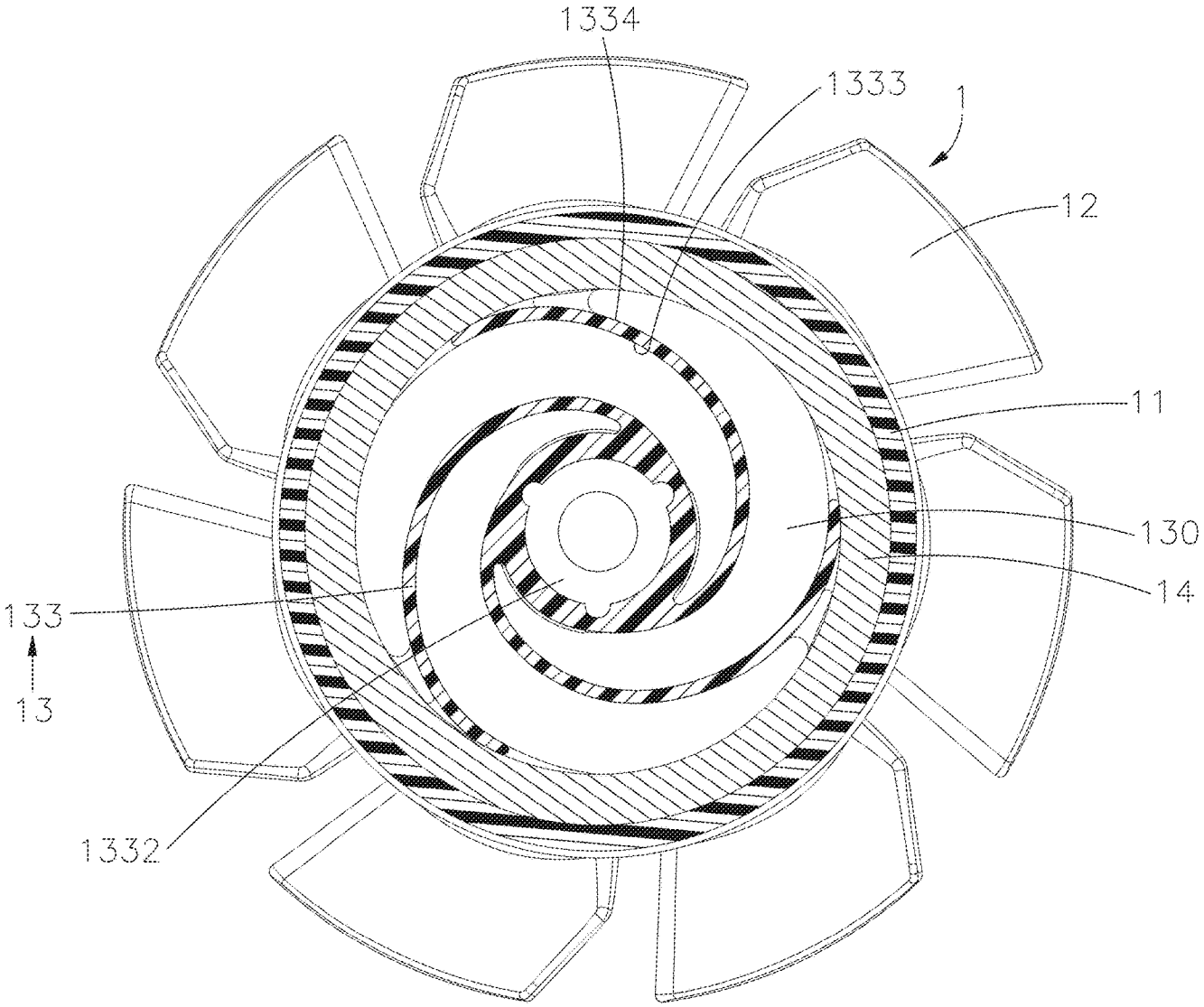
FIG. 10 is a bottom view of the fan wheel according to the second embodiment of the present invention.
Figure 11:
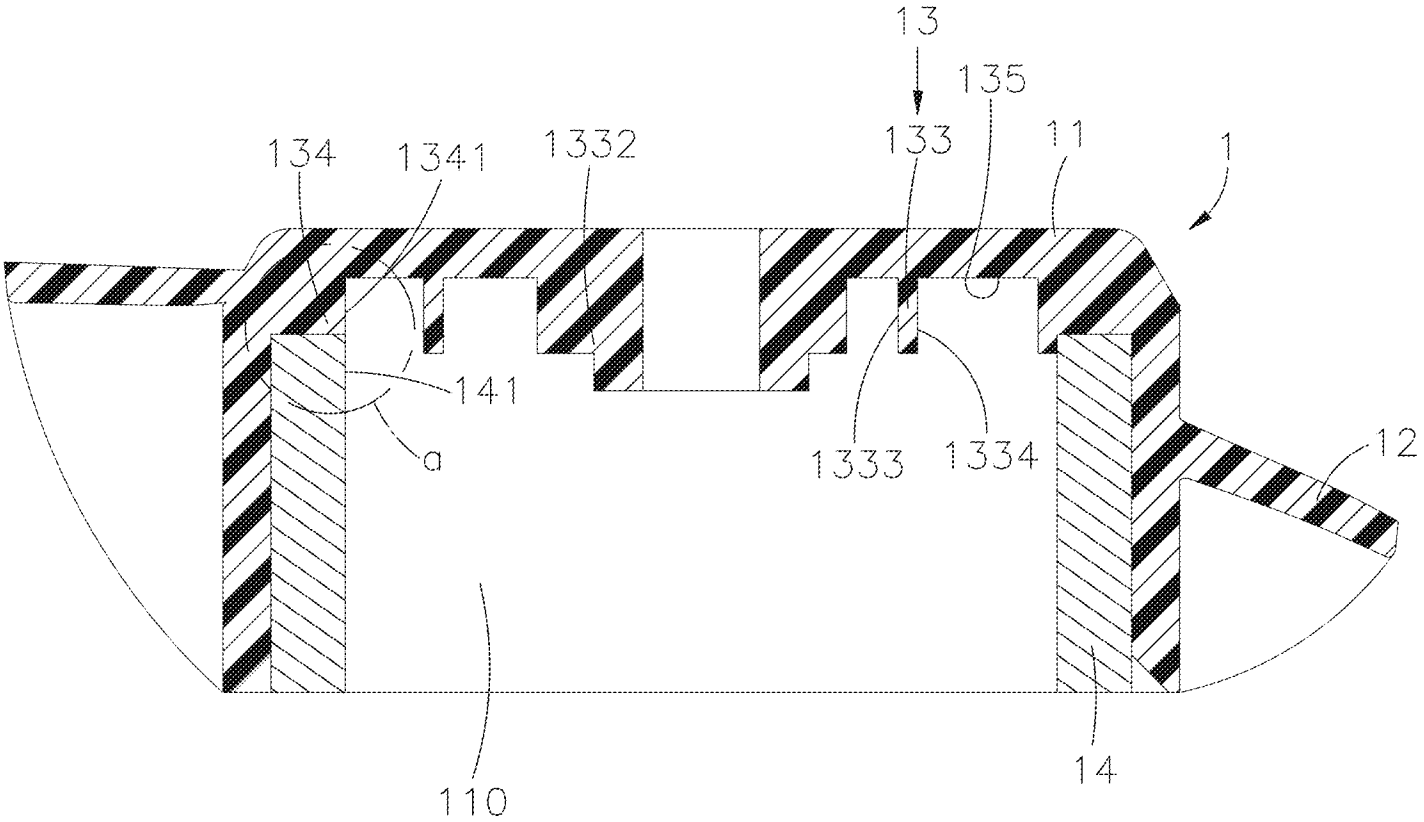
FIG. 11 is a side cross-sectional view of the fan wheel according to the first embodiment of the present invention.
Figure 12:
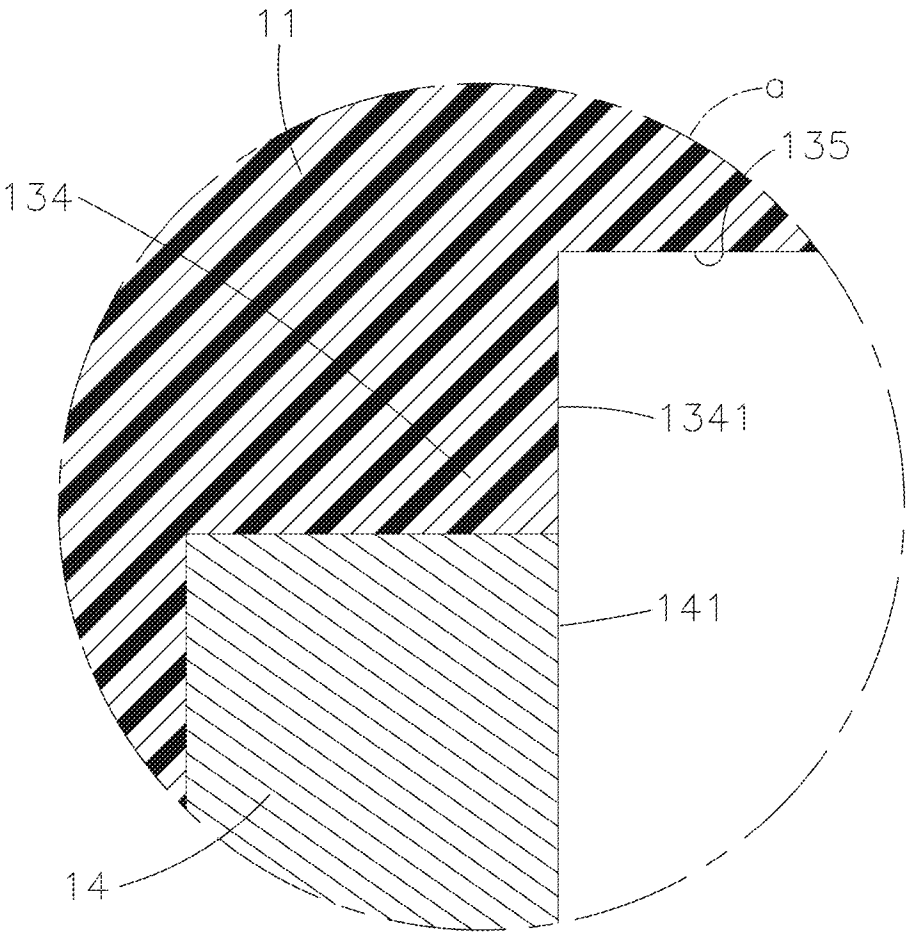
FIG. 12 is a partial enlarged view of part a of FIG. 11 of the present invention.

Also, please refer to FIG. 9. The above-mentioned fan frame 2 is provided with a ⊓-shaped shaft seat 21 in the accommodation space 20. A circular circuit board 22 without a middle hole is provided on the outside of the bottom of the ⊓-shaped shaft seat 21 to obtain a larger area for accommodating electronic components (a circular circuit board 22 with a middle hole can also be provided to obtain a higher bearing 31 height). Alternatively, a plurality of air flow channels 220 may be appropriately provided at each position on the circuit board 22 where electronic components are not provided, and the circuit board 22 and each stator silicon steel sheet set 41 of the preset motor 4 on the ⊓-shaped shaft seat 21 are electrically connected. A static blade pressure plate 215 can be provided on the outside of the bottom receiving space 210 of the shaft seat 21, and a bottom frame can be provided below the receiving space 210 to protect the circuit board 22.

When the above-mentioned fan of the present invention is actually operated, the preset motor 4 in the internal space 110 of the fan hub 11 of the fan wheel 1 and in the accommodation space 20 of the fan frame 2 is operated for each stator silicon steel sheet set 41 to cooperate with the rotor magnet 14, so that the preset rotating shaft 3 drives the fan hub 11 of fan wheel 1 and the plurality of fan blades 12 to rotate. By rotating the fan wheel 1, the space of the air duct 130 sucks in hot air by the air inlet slot 131 and the sucked in hot air is squeezed into the narrow space through the wide space, and then the hot air is sent out through the escape space 140 through the guidance of the airflow turning curved surface 132. This will drive the external low-temperature airflow outside the shaft seat cover 216 at the bottom of the fan frame 2 to pass through the plurality of through holes 201 and the air flow duct 410 under the circuit board 22 via the plurality of air flow channels 220 set on the shaft seat 21 and the circuit board 22. The airflow is then gathered at the air flow duct 410 on the circuit board 22 and then enters the circulation space 40 in each stator silicon steel sheet set 41. Then, the airflow enters the air inlet slot 131 on one side of the air duct 130 (that is, the air duct 130 wide space) formed by the airflow guide ring inner peripheral surface 1341 of the air diversion radiator plate 13 and the adjacent airflow guide rib outer peripheral surface 1334. After the airflow is squeezed from the wide space of the air duct 130 into the narrow space, the high-temperature airflow is guided by the airflow turning curved surface 132 to hit the circuit board 22 along the escape space 140, and then the high-temperature airflow is turned at a predetermined angle such as 90° (or greater than 90°, the better angle may be) 90°. After turning, the high-temperature airflow can be discharged outward along the escape space 140 formed between the rotor magnet 14 and the stator silicon steel sheet sets 41. Thus, the high temperature, hot air generated by the preset motor 4 in the internal space 110 cooperating with the high-wattage rotation of the rotor magnet 14 can be carried away and cooled down. It can be used for the purpose of rapid circulation of external low-temperature airflow outside the accommodation space 20 and the fan frame 2, reducing the impact on the normal operation of the preset motor 4 and fan wheel 1, and extending the service life of the fan.

Figure 13:
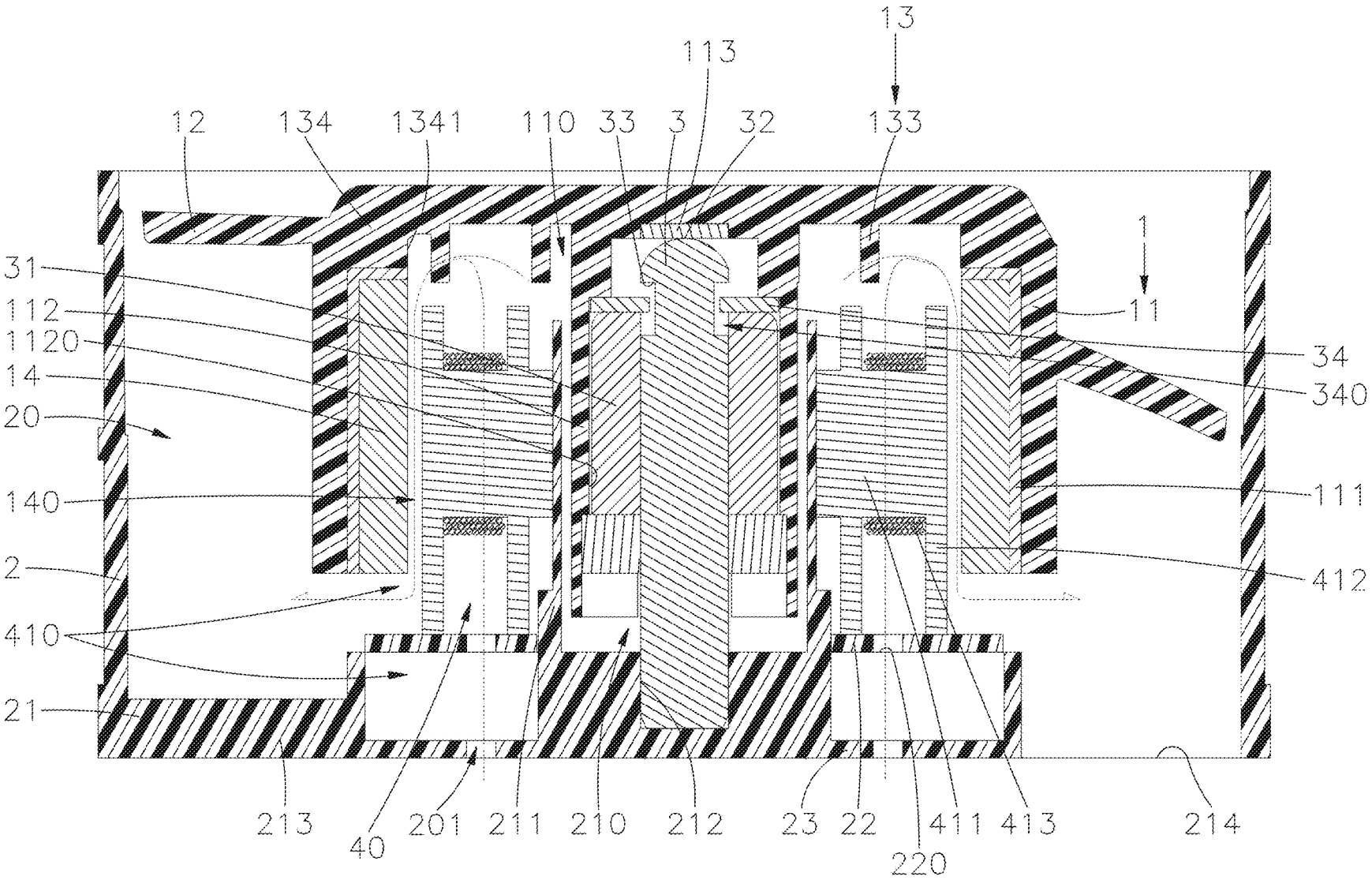
FIG. 13 is a side cross-sectional view of the fifth embodiment of the present invention.

Another fan wheel heat dissipation structure can also achieve the same effect as above. FIG. 13 is a side cross-sectional view of the fifth embodiment of the present invention, comprising a fan wheel 1 and a fan frame 2 (assuming there is no air flow channels 220 and through holes 201 at this time, only the air flow duct 410). The fan wheel 1 comprises a fan hub 11 and a plurality of fan blades 12 surrounding its outer surface. The fan hub 11 is provided with an internal space 110, and the wall surface 111 of the internal space 110 is provided with a rotor magnet 14, and the center of the internal space 110 is provided with a rotating shaft bearing seat 112. The top surface of the internal space 110 is provided with an air diversion radiator plate 13 surrounding the rotating shaft bearing seat 112, and at least one air duct 130 is formed in the space between the at least one airflow guide rib 133 of the air diversion radiator plate 13 and the airflow guide ring 134 of the air diversion radiator plate 13. An air inlet slot 131 is formed on one side of the air duct 130 to guide the external airflow to enter, and an airflow turning curved surface 132 is formed on the other side to guide the external airflow to be extruded outward.

The fan frame 2 comprises a shaft seat 21, and a shaft sleeve 211 is provided on the shaft seat 21. A receiving space 210 is provided inside the shaft sleeve 211 for assembling the rotating shaft bearing seat 112 of the fan wheel 1. A rotating shaft 3 for assembly of the preset rotating shaft bearing seat 112 is protruded inside the receiving space 210 of the shaft sleeve 211 of the shaft seat 21.

The top surface of the internal space 110 is provided with an air diversion radiator plate 13 surrounding the preset rotating shaft bearing seat 112. The air diversion radiator plate 13 is composed of at least one airflow guide rib 133 and an airflow guide ring 134, and the wall surface 111 of the internal space 110 of the fan hub 11 below the airflow guide ring 134 is provided with the rotor magnet 14. The airflow guide ring inner peripheral surface 1341 is connected to the rotor magnet inner peripheral surface 141 to facilitate the smooth airflow and guide the hot air to flow through the escape space 140. The air duct 130 is formed by forming at least one space from wide to narrow between the airflow guide rib 133 of the air diversion radiator plate 13 and the airflow guide ring 134 of the air diversion radiator plate 13. That is, the airflow guide rib 133 extends from the outside of the rotating shaft pivot seat 1332 in a parabolic path to the airflow guide ring inner peripheral surface 1341 and is connected at an approximate tangent to form at least one air duct 130. The wide space on one side of the air duct 130 forms an air inlet slot 131 that guides external airflow to enter, and the narrow space on the other side of the air duct 130 forms the airflow turning curved surface 132 that guides the airflow to be extruded downward and outward. An escape space 140 is formed between the rotor magnet inner peripheral surface 141 and the outer silicon steel sheet 412 for the extruded hot air to be discharged outward.

The accommodation space 20 inside the fan frame 2 can be used to assemble the fan wheel 1, that is, a shaft sleeve 211 is protruding from the shaft seat 21 inside the accommodation space 20, and a preset rotating shaft 3 can be assembled at the center below the shaft sleeve 211 of shaft seat 21. A circuit board 22 is provided on the shaft seat 21 in the accommodation space 20, and a plurality of stator silicon steel sheet sets 41 of the preset motor 4 are provided on the circuit board 22 (including a plurality of inner silicon steel sheets 411 and a plurality of outer silicon steel sheets 412 and enameled wire winding sets 413). The I-shaped stator silicon steel sheet sets 41 are arranged around the shaft sleeve 211 of the shaft seat 21, and a circulation space 40 is formed between the plurality of inner silicon steel sheets 411, the plurality of outer silicon steel sheets 412 and the enameled wire winding set 413 of each I-shaped stator silicon steel sheet set 41. There is an air flow duct 410 between the bottom surface of the stator silicon steel sheet sets 41 and the circuit board 22, and an escape space 140 is formed between each stator silicon steel sheet set 41 of the preset motor 4 and the rotor magnet 14.

The above-mentioned fan wheel 1 of the present invention forms at least one air duct 130 for guiding airflow into the space between each airflow guide rib outer peripheral surface 1334 and airflow guide ring inner peripheral surface 1341 of the internal space 110 of the fan hub 11. The wide space on one side of the air duct 130 forms an air inlet slot 131, which guides the external low-temperature air flow from the air flow duct 410 between the bottom surface of the stator silicon steel sheet set 41 and the circuit board 22 to enter the circulation space 40 between each stator silicon steel sheet set 41 (including a plurality of inner silicon steel sheets 411, a plurality of outer silicon steel sheets 412 and the enameled wire winding set 413) of the preset motor 4. Then airflow enters the air inlet slot 131 and is squeezed to the airflow turning curved surface 132 of the narrow space on the other side of the air duct 130. After the guided airflow is squeezed, through the airflow turning curved surface 132, the high temperature generated by each stator silicon steel sheet set 41 cooperating with the high-speed rotation of the rotor magnet 14 can be discharged to the outside and cooled down the air through the escape space 140 between the rotor magnet 14 and the outer silicon steel sheets 412, thereby reducing the temperature raised when the preset motor 4 operates at high speed.

Please continue to refer to FIG. 13 as shown above, and assume that there are air flow channels 220 in the middle of circuit board 22 or between the circuit board 22 and the shaft seat 21. At this time, there are no through holes 201, only air flow channels 220 and air flow duct 410. There is an accommodation space 20 inside the fan frame 2 for assembling the fan wheel 1. A shaft sleeve 211 is protruding from the shaft seat 21 inside the accommodation space 20. A preset rotating shaft 3 can be assembled at the center below the shaft sleeve 211 of the shaft seat 21, and a circuit board 22 is provided on the shaft seat 21 in the accommodation space 20. The circuit board 22 is provided with a plurality of stator silicon steel sheet sets 41 of the preset motor 4 (including a plurality of inner silicon steel sheets 411, a plurality of outer silicon steel sheets 412 and enameled wire winding sets 413). The I-shaped stator silicon steel sheet sets 41 are arranged around the shaft sleeve 211 of the shaft seat 21, and a circulation space 40 is formed between the plurality of inner silicon steel sheets 411, the plurality of outer silicon steel sheets 412 and the enameled wire winding set 413 of each I-shaped stator silicon steel sheet set 41. There are air flow ducts 410 above and below the circuit board 22 on the bottom surface of the stator silicon steel sheet sets 41, and an escape space 140 is formed between each stator silicon steel sheet set 41 of the preset motor 4 and the rotor magnet 14.

The above-mentioned fan wheel 1 of the present invention forms at least one air duct 130 for guiding airflow into the space between each airflow guide rib outer peripheral surface 1334 and airflow guide ring inner peripheral surface 1341 of the internal space 110 of the fan hub 11. The wide space on one side of the air duct 130 forms an air inlet slot 131, which guides the external low-temperature air flow from the air flow ducts 410 above and below the circuit board 22 on the bottom surface of the stator silicon steel sheet sets 41 to enter the circulation space 40 between each stator silicon steel sheet set 41 (including a plurality of inner silicon steel sheets 411, a plurality of outer silicon steel sheets 412 and the enameled wire winding set 413) of the preset motor 4. Then it enters the air inlet slot 131 and is squeezed to the airflow turning curved surface 132 of the narrow space on the other side of the air duct 130. After the airflow is squeezed, through the airflow turning curved surface 132, the high temperature generated by each stator silicon steel sheet set 41 cooperating with the high-speed rotation of the rotor magnet 14 can be discharged to the outside and cooled down the air through the escape space 140 between the rotor magnet 14 and the outer silicon steel sheets 412, thereby reducing the temperature raised when the preset motor 4 operates at high speed.

Also, please continue to look at FIG. 13. At this time, there are air flow channels 220 in the middle of the circuit board 22 or between the circuit board 22 and the shaft seat 21, through holes 201, and air flow ducts 410 above and below the circuit board 22. The fan wheel 1 of the present invention is further provided with a plurality of through holes 201 at the bottom of the accommodation space 20 outside the shaft seat 21 to correspond to the internal space 110 of the fan hub 11, and there is a circuit board 22 on the shaft seat 21 in the accommodation space 20. The circuit board 22 is provided with a plurality of stator silicon steel sheet sets 41 of the preset motor 4 (including a plurality of inner silicon steel sheets 411, a plurality of outer silicon steel sheets 412 and enameled wire winding sets 413). The I-shaped stator silicon steel sheet sets 41 are arranged around the shaft seat 21, and a circulation space 40 is formed between the plurality of inner silicon steel sheets 411, the plurality of outer silicon steel sheets 412 and the enameled wire winding set 413 of each I-shaped stator silicon steel sheet set 41. There is an air flow channel 220 between the circuit board 22 and the shaft seat 21. The wall surface 111 of the internal space 110 of the fan hub 11 is equipped with a rotor magnet 14. An escape space 140 is formed between the rotor magnet 14 and the plurality of outer silicon steel sheets 412 for air flow to pass through and be discharged to the outside, so as to reduce the temperature of each stator silicon steel sheet set 41 of the preset motor 4 in the internal space 110 (including a plurality of inner silicon steel sheets 411, a plurality of outer silicon steel sheets 412 and the enameled wire winding set 413). The fan frame 2 has a U-shaped shaft seat 21 inside. A circuit board 22 is set on the outside of the shaft sleeve 211 of the shaft seat 21 so that the circuit board 22 can be electrically connected to each stator silicon steel sheet set 41 of the preset motor 4.

The above-mentioned fan wheel 1 of the present invention forms at least one air duct 130 for guiding airflow into the space between each airflow guide rib outer peripheral surface 1334 and airflow guide ring inner peripheral surface 1341 of the internal space 110 of the fan hub 11. The wide space on one side of the air duct 130 forms an air inlet slot 131, which guides the external low-temperature air flow into the at least one air duct 130. The other side of the air duct 130 forms an airflow turning curved surface 132 that guides the external airflow to be extruded outward.

Figure 14:
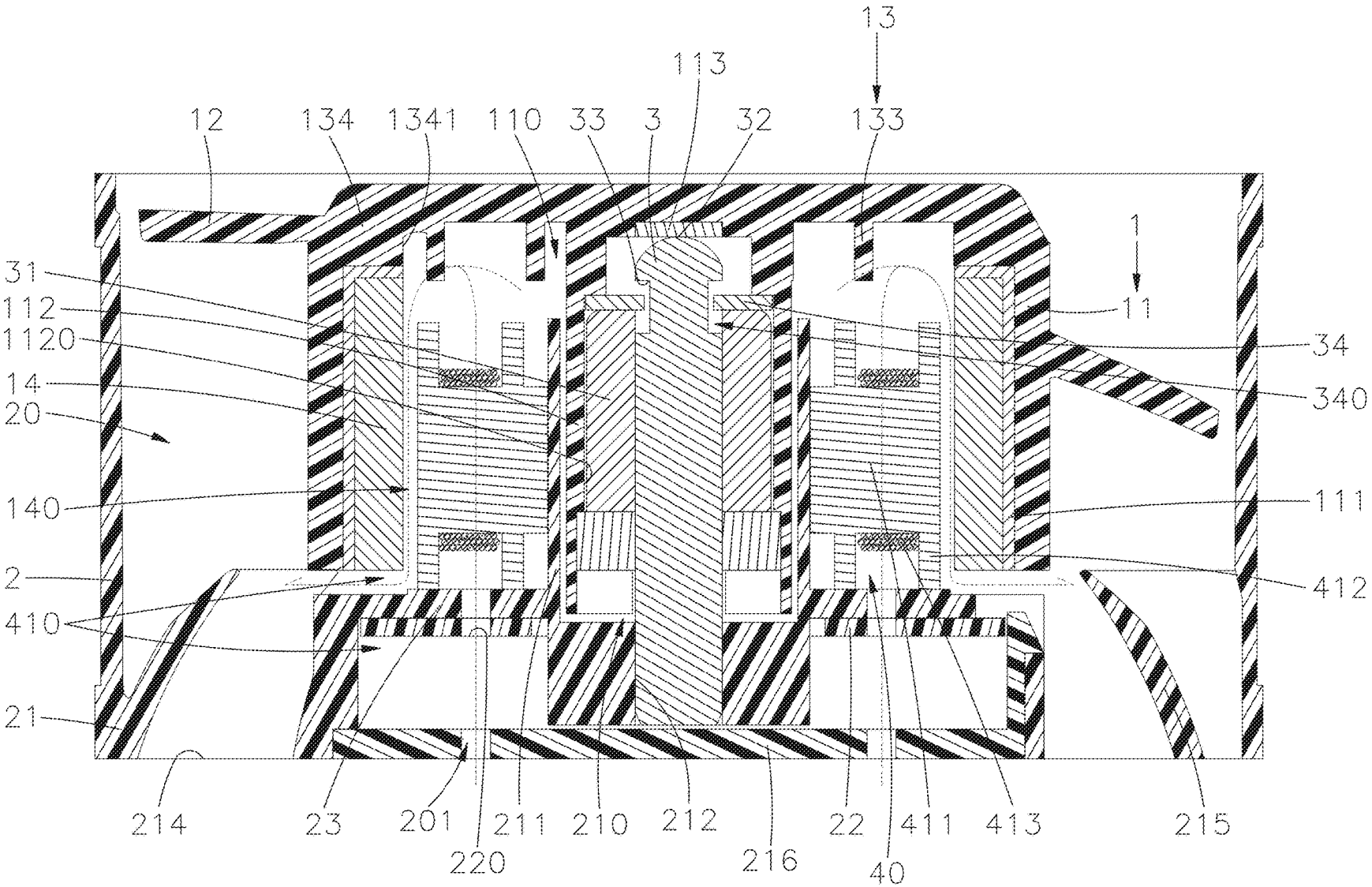
FIG. 14 is a side cross-sectional view of the sixth embodiment of the present invention.

Furthermore, please continue to look at FIG. 14, which is a side cross-sectional view of the sixth embodiment of the present invention, comprising a fan wheel 1 and a fan frame 2. The fan wheel 1 comprises a fan hub 11 and a plurality of fan blades 12 surrounding its outer surface. The fan hub 11 is provided with an internal space 110, and the wall surface 111 of the internal space 110 is provided with a rotor magnet 14. There is a rotating shaft bearing seat 112 at the center of the internal space 110, and an air diversion radiator plate 13 surrounding the rotating shaft bearing seat 112 is provided on the top surface of the internal space 110. At least one air duct 130 is formed in the space between each airflow guide rib 133 of the air diversion radiator plate 13 and the airflow guide ring 134 of the air diversion radiator plate 13. An air inlet slot 131 is formed on one side of the air duct 130 to guide the external airflow to enter, and an airflow turning curved surface 132 is formed on the other side to guide the external airflow to be extruded outward.

The fan frame 2 comprises a shaft seat 21, and a shaft sleeve 211 is provided on the shaft seat 21. A receiving space 210 is provided inside the shaft sleeve 211 for assembling the fan wheel 1 and the rotating shaft bearing seat 112, that is, a rotating shaft 3 for assembly of the preset rotating shaft bearing seat 112 is protruded inside the receiving space 210 of the shaft sleeve 211 of the shaft seat 21.

The top surface of the internal space 110 is provided with an air diversion radiator plate 13 surrounding the preset rotating shaft bearing seat 112. The air diversion radiator plate 13 is composed of at least one airflow guide rib 133 and an airflow guide ring 134. The wall surface 111 of the internal space 110 of the fan hub 11 below the airflow guide ring 134 is provided with the rotor magnet 14. The airflow guide ring inner peripheral surface 1341 is connected to the rotor magnet inner peripheral surface 141 to facilitate the smooth flow of air through the escape space 140. At least one space from wide to narrow is formed between each airflow guide rib 133 of the air diversion radiator plate 13 and the airflow guide ring 134 of the air diversion radiator plate 13 to form the air duct 130, that is, the airflow guide rib 133 extends from the outside of the rotating shaft pivot seat 1332 in a parabolic path to the airflow guide ring inner peripheral surface 1341 and is connected at an approximate tangent to form at least one air duct 130. The wide space on one side of the air duct 130 forms an air inlet slot 131 that guides the external airflow to enter, and the narrow space on the other side of the air duct 130 forms the airflow turning curved surface 132 that guides the airflow to be squeezed downward and outward. An escape space 140 is formed between the rotor magnet inner peripheral surface 141 and the outer silicon steel sheets 412 for the extruded hot air to be discharge outward.

The above-mentioned shaft seat 21 inside the fan frame 2 can be in different design patterns such as U shape or ⊓ shape. A shaft sleeve 211 is protruding inside the shaft seat 21. The shaft seat 21 can be assembled with the preset rotating shaft 3. A plurality of through holes 201 are provided at the bottom of the accommodation space 20 outside the shaft seat 21 to correspond to the internal space 110 of the fan hub 11. There is a U-shaped shaft seat 21 in the accommodation space 20. The U-shaped shaft seat 21 is provided with a circuit board 22 on the shaft sleeve 211. The circuit board 22 is provided with a plurality of stator silicon steel sheet sets 41 of the preset motor 4 (including a plurality of inner silicon steel sheets 411, a plurality of outer silicon steel sheets 412 and enameled wire winding sets 413). A plurality of air flow channels 220 can be provided on the circumference of the shaft sleeve 211 near the shaft seat 21 on the circuit board 22. The plurality of air flow channels 220 can be located at any appropriate positions on the circuit board 22, especially the plurality of air flow channels 220 can be set on the circuit board 22 below the stator silicon steel sheet sets 41. The plurality of air flow channels 220 may also be provided at any appropriate locations on the circuit board 22 where electronic components are not provided. It is not limited to the location where the plurality of air flow channels 220 set on the circuit board 22.

Also, as shown in FIG. 14, the plurality of air flow channels 220 can be appropriately installed at various locations on the circuit board 22 where electronic components are not provided. The circuit board 22 is electrically connected to each stator silicon steel sheet set 41 of the preset motor 4 on the ⊓-shaped shaft seat 21. A static blade pressure plate 215 can be set on the outside of the receiving space 210 at the bottom of the shaft seat 21, and a bottom frame can be set below the receiving space 210 to protect the circuit board 22.

When the above-mentioned fan of the present invention is actually operated, the preset motor 4 in the internal space 110 of the fan hub 11 of the fan wheel 1 and the accommodation space 20 of the fan frame 2 is operated for each stator silicon steel sheet set 41 to cooperate with the rotor magnet 14, so that the preset rotating shaft 3 drives the fan hub 11 of fan wheel 1 and the plurality of fan blades 12 to rotate. By rotating the fan wheel 1, the space of the air duct 130 sucks in hot air by the air inlet slot 131 and the sucked in hot air is squeezed into the narrow space through the wide space, and then the hot air is sent out through the escape space 140 through the guidance of the airflow turning curved surface 132. This will drive the external low-temperature airflow outside the shaft seat cover 216 at the bottom of the fan frame 2 to pass through the plurality of through holes 201 and the air flow duct 410 under the circuit board 22 via the plurality of air flow channels 220 set on the shaft seat 21 and the circuit board 22. The airflow is then gathered at the air flow duct 410 on the circuit board 22 and then enters the circulation space 40 in each stator silicon steel sheet set 41, and then enters the air inlet slot 131 on one side of the air duct 130 (that is, the air duct 130 wide space) formed by the airflow guide ring inner peripheral surface 1341 of the air diversion radiator plate 13 and the adjacent airflow guide rib outer peripheral surface 1334. After the airflow is squeezed from the wide space of the air duct 130 into the narrow space, the high-temperature airflow is guided by the airflow turning curved surface 132 to hit the circuit board 22 along the escape space 140, and then the high-temperature airflow is turned at a predetermined angle such as 90° (or other angles such as 30°, 45° or 60°, etc., the better angle can be 90°). After turning, the high-temperature airflow can be discharged outward. Thus, the high temperature, hot air generated by the preset motor 4 in the internal space 110 cooperating with the high-wattage rotation of the rotor magnet 14 can be carried away and cooled down. It can be used for the purpose of rapid circulation of external low-temperature airflow between the accommodation space 20 and the fan frame 2, reducing the impact on the normal operation of the preset motor 4 and fan wheel 1, and extending the service life of the fan.

The above are only preferred embodiments of the present invention and do not limit the patent scope of the present invention. Therefore, all simple modifications and equivalent structural changes made by using the description and drawings of the present invention shall be included in the patent scope of the present invention and shall be clearly stated.

To sum up, the above-mentioned fan wheel heat dissipation structure of the present invention can indeed achieve its effect and purpose when used. Therefore, the present invention is truly an invention with excellent practicality. In order to meet the application requirements for an invention patent, I filed the application in accordance with the law and hope that the review committee will approve the case as soon as possible to protect the inventor's hard work on research and development. If the review committee has any doubts, please feel free to send us a letter for instructions. The inventor will do our best to cooperate. We sincerely appreciate it.

What the invention claimed is:

1. A fan wheel heat dissipation structure, comprising a fan wheel and a fan frame, wherein said fan wheel comprises a fan hub provided with an internal space, a plurality of fan blades surrounding an outer surface of said fan hub, a preset rotating shaft inserted through said internal space, an air diversion radiator plate surrounding said preset rotating shaft located on a top surface of said internal space, said air diversion radiator plate comprising at least an airflow guide rib and an airflow guide ring, and at least an air duct formed in the space between at least one said airflow guide rib and said airflow guide ring of said air diversion radiator plate, each said air duct comprising an air inlet slot formed on one side thereof to guide the external airflow to enter and an airflow turning curved surface formed on an opposite side thereof to guide the external airflow entering said air inlet slot to be extruded outward;

said fan frame comprises an accommodation space for assembling said fan wheel, a shaft seat mounted in said accommodation space, a shaft seat disc mounted in said shaft seat, a shaft seat bracket, a fan air outlet, and a shaft sleeve protruding from said shaft seat disc for assembly of said preset rotating shaft;

wherein said air diversion radiator plate comprises said airflow guide ring surrounding said preset rotating shaft and a plurality of said airflow guide ribs; a rotor magnet is provided on a wall surface of said internal space of said fan hub below said airflow guide ring; at least one said air duct formed in the space between at least one said airflow guide rib and said airflow guide ring of said air diversion radiator plate extends from the outside of a rotating shaft pivot seat at each said airflow guide rib to an inner peripheral surface of said airflow guide ring from wide to narrow, and said air inlet slot is formed in the wide space on one side of said air duct to guide external airflow to enter, and said airflow turning curved surface is formed in the narrow space on the opposite side of said air duct to guide the entered airflow to be squeezed downward and outward;

wherein said air diversion radiator plate comprises said airflow guide ring surrounding the exterior of said preset rotating shaft, and the plurality of said airflow guide ribs; said rotor magnet is provided on the said wall surface of said internal space of said fan hub below said airflow guide ring; the said inner peripheral surface of said airflow guide ring aligned with the said inner peripheral surface of said rotor magnet to facilitate the smooth flow of air through an escape space; at least one space from narrow to wide and then to narrow is formed between each two adjacent said airflow guide ribs of said air diversion radiator plate, and said airflow guide ribs extend from the outside of said rotating shaft pivot seat at each said airflow guide rib in a parabolic path to the said inner peripheral surface of said airflow guide ring and are connected at an approximate tangent to form at least one said air duct, and said air inlet slot is formed at the narrow to wide space on one side of said air duct near said rotating shaft pivot seat to guide the external airflow to enter, and said airflow turning curved surface is formed at the narrowest space from the wide to narrow space on an opposite side of said air duct to guide airflow to be squeezed downward and discharged outward.

2. The fan wheel heat dissipation structure as claimed in claim 1, wherein said shaft seat mounted in said accommodation space inside said fan frame is provided with a circuit board for electrically connecting with a plurality of stator silicon steel sheet sets of a preset motor, and at least an air flow duct is formed on said circuit board for air flow to pass through, said at least one said air flow duct being selectively installed on said circuit board or between said circuit board and said shaft seat.

3. The fan wheel heat dissipation structure as claimed in claim 2, wherein said circuit board is provided at a bottom of said shaft seat of said fan frame, and a bottom frame seat is provided below said circuit board, and a plurality of said through holes formed on the bottom of said shaft seat, said circuit board and said bottom frame seat under each said stator silicon steel sheet set.

4. A fan wheel heat dissipation structure, comprising a fan wheel and a fan frame, wherein said fan wheel comprises a fan hub provided with an internal space, a plurality of fan blades surrounding an outer surface of said fan hub, a preset rotating shaft inserted through said internal space, an air diversion radiator plate surrounding said preset rotating shaft located on a top surface of said internal space, said air diversion radiator plate comprising at least an airflow guide rib and an airflow guide ring, and at least an air duct formed in the space between at least one said airflow guide rib and said airflow guide ring of said air diversion radiator plate, each said air duct comprising an air inlet slot formed on one side thereof to guide the external airflow to enter and an airflow turning curved surface formed on an opposite side thereof to guide the external airflow entering said air inlet slot to be extruded outward;

said fan frame comprises an accommodation space for assembling said fan wheel, a shaft seat mounted in said accommodation space, a shaft seat disc mounted in said shaft seat, a shaft seat bracket, a fan air outlet, and a shaft sleeve protruding from said shaft seat disc for assembly of said preset rotating shaft;

wherein said air diversion radiator plate comprises said airflow guide ring surrounding said preset rotating shaft and a plurality of said airflow guide ribs; a rotor magnet is provided on a wall surface of said internal space of said fan hub below said airflow guide ring; at least one said air duct formed in the space between at least one said airflow guide rib and said airflow guide ring of said air diversion radiator plate extends from the outside of a rotating shaft pivot seat at each said airflow guide rib to an inner peripheral surface of said airflow guide ring from wide to narrow, and said air inlet slot is formed in the wide space on one side of said air duct to guide external airflow to enter, and said airflow turning curved surface is formed in the narrow space on the opposite side of said air duct to guide the entered airflow to be squeezed downward and outward.

5. A fan wheel heat dissipation structure, comprising a fan wheel and a fan frame, wherein said fan wheel comprises a fan hub provided with an internal space, a plurality of fan blades surrounding an outer surface of said fan hub, a preset rotating shaft inserted through said internal space, an air diversion radiator plate surrounding said preset rotating shaft located on a top surface of said internal space, said air diversion radiator plate comprising at least an airflow guide rib and an airflow guide ring, and at least an air duct formed in the space between at least one said airflow guide rib and said airflow guide ring of said air diversion radiator plate, each said air duct comprising an air inlet slot formed on one side thereof to guide the external airflow to enter and an airflow turning curved surface formed on an opposite side thereof to guide the external airflow entering said air inlet slot to be extruded outward;

said fan frame comprises an accommodation space for assembling said fan wheel, a shaft seat mounted in said accommodation space, a shaft seat disc mounted in said shaft seat, a shaft seat bracket, a fan air outlet, and a shaft sleeve protruding from said shaft seat disc for assembly of said preset rotating shaft;

wherein a plurality of through holes are formed on a bottom of said fan frame and the outside of said shaft seat of said fan frame for air flow to pass through.

* * * * *